US006272784B1

(12) United States Patent
Ringers

(10) Patent No.: US 6,272,784 B1
(45) Date of Patent: Aug. 14, 2001

(54) FIREARM TRIGGER LOCK

(76) Inventor: Derek Ringers, 201 Middleton Ct., Churchville, MD (US) 21028

( * ) Notice: Subject to any disclaimer, the term of this patent is extended or adjusted under 35 U.S.C. 154(b) by 0 days.

(21) Appl. No.: 09/411,334

(22) Filed: Oct. 1, 1999

(51) Int. Cl.[7] ..... F41A 17/00
(52) U.S. Cl. ..... 42/70.07; 42/70.11
(58) Field of Search ..... 42/70.07, 70.06, 42/70.01, 70.11

(56) References Cited

U.S. PATENT DOCUMENTS

| | | | | |
|---|---|---|---|---|
| 5,024,017 | * | 6/1991 | Nishioka | 42/70.07 |
| 5,050,328 | | 9/1991 | Insko | 42/70 |
| 5,392,551 | * | 2/1995 | Simpson | 42/70.07 |
| 5,400,538 | | 3/1995 | Shannon | 42/70.07 |
| 5,450,684 | * | 9/1995 | Harris . | |
| 5,535,605 | * | 7/1996 | Werner | 70/14 |
| 5,544,440 | | 8/1996 | Stockman | 42/70.07 |
| 5,551,181 | | 9/1996 | Upton | 42/70.11 |
| 5,638,627 | | 6/1997 | Klein | 42/70.07 |
| 5,647,158 | | 7/1997 | Eskelinen et al. | 42/70.07 |
| 5,680,723 | | 10/1997 | Ruiz | 42/70.11 |
| 5,704,152 | | 1/1998 | Harrison et al. | 42/70.07 |
| 5,724,760 | | 3/1998 | Langner | 42/70.07 |
| 5,755,054 | | 5/1998 | Tuller | 42/70.07 |
| 5,768,819 | | 6/1998 | Neal | 42/96 |
| 5,778,586 | * | 7/1998 | Carlson | 42/70.07 |
| 5,784,819 | | 7/1998 | Roper | 42/70.11 |
| 5,829,179 | | 11/1998 | Carter et al. | 42/70.07 |

* cited by examiner

*Primary Examiner*—Charles T. Jordan
*Assistant Examiner*—Christian M. Best
(74) *Attorney, Agent, or Firm*—Larry J. Guffey

(57) ABSTRACT

A trigger lock for use on a firearm having a trigger and a trigger guard includes a plurality of spaced apart pins and means for holding and locking these pins in their spaced apart relationship. These pins cooperate to prevent trigger movement when one of them is placed and held behind the trigger, while another is placed and held against the inside of the trigger guard at a position behind the trigger.

6 Claims, 4 Drawing Sheets

FIREARM TRIGGER LOCK

BACKGROUND OF THE INVENTION

1. Field of the Invention

The present invention generally relates to firearms. More particularly, this invention relates to an external trigger lock for firearms.

2. Description of the Related Art

The use of external, firearm trigger locks is well known in the prior art. More specifically, such locks are known basically to consist of familiar structural configurations. These devices utilize a plurality of different types of wrenches, keys and other locking systems to prevent unauthorized or accidental operation of the firearm. For example, U.S. Pat. No. 5,755,054 requires a special key wrench, whereas U.S. Pat. Nos. 5,400,538, 5,647,158, and 5,535,605 utilize various types of combination locks that do not require the separate use of a key or wrench. Meanwhile, U.S. Pat. No. 5,050,328 employs only a childproof locking system that disengages the lock by manually spreading a pair of pins.

Many of these prior art devices are configured to totally enclose a firearm's trigger guard. For example, see U.S. Pat. Nos. 5,050,328, 5,400,538, 5,535,605, 5,544,440, 5,755,054, 5,778,586 5,704,152 and 5,829,179. Some even enclose portions of the firearm's barrel and handle. For example, see U.S. Pat. Nos. 5,768,819 and 5,680,723. Such enclosure techniques significantly differ from the present invention's total immobilization of a firearm's trigger, and leave the firearms that employ such techniques susceptible to the hazards associated with manipulating the enclosure in a manner so as to still allow the firearm to be discharged.

The trigger lock according to the present invention substantially departs from conventional concepts and the design of the prior art, and in so doing provides an apparatus that is especially well suited for easy and rapid engagement and disengagement from a variety of firearms.

Despite the prior art, there exists a continuing need for new and improved firearm trigger locks. The present invention substantially fulfills many such needs.

SUMMARY OF THE INVENTION

In accordance with one preferred embodiment of the present invention, a new and improved trigger lock for use on a firearm having a trigger and a trigger guard comprises a pair of spaced apart pins that cooperate to prevent trigger movement by having one of the pins placed behind the trigger while the other pin is fixed against the inside of the trigger guard at a position behind the trigger, and means for holding and locking these pins in this spaced apart relationship.

In a preferred embodiment, the means for holding these pins in this spaced apart relationship comprises: (a) a hollow base with an open top surface and a bottom, exterior surface having an elongated slot, (b) a latch plate having a toothed section, with the latch plate being slidably mounted in the base, (c) a keeper plate also having a toothed section, with this keeper plate being movable between a first position in which these toothed sections mesh together so as to restrict the latch plate from sliding, and a second position in which the toothed sections are not meshed so that the latch plate may slide within the base, (d) a set cylinder fixed for axial motion within the base so as to engage a portion of the keeper plate and move it between its first and second positions, (e) a means for biasing said cylinder into its second position, and (f) a cover plate that covers the base's open top surface and cooperates to hold and regulate the motion of the plates, cylinder and biasing means mounted within the base.

With such a means for holding the pins apart, the pins themselves consist of a movable pin, one end of which is affixed to the latch plate such that its other free end extends normal to the plate and passes through the base's slot where it is free to be placed against and behind the trigger, and a fixed pin which has its base end affixed to the base exterior surface such that its other free end extends from the base so that it may be placed against a position on the inside of the trigger guard, behind the trigger, and in a spaced apart and operative relation to the movable pin free end.

Thus, there has thus been summarized above, rather broadly, the more important features of the present invention in order that the detailed description that follows may be better understood and appreciated. There are, of course, additional features of the invention that will be described hereinafter and which will form the subject matter of the claims appended thereto.

In this respect, before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new trigger lock apparatus which has many of the advantages of the devices mentioned heretofore and many novel features that result in a firearm trigger lock which is not anticipated, rendered obvious, suggested, or even implied by any of the prior art devices, either alone or in any combination thereof.

It is another object of the present invention to provide a new and improved firearm trigger lock which may be easily and efficiently manufactured and marketed.

It is a further object of the present invention to provide a new and improved firearm trigger lock which is of durable and reliable construction.

It is a still further object of the present invention is to provide a new and improved firearm trigger lock which provides some of the advantages of the apparatuses of the prior art, while simultaneously overcoming some of the disadvantages normally associated therewith.

These and other objects and advantages of the present invention will become readily apparent as the invention is better understood by reference to the accompanying drawings and the detailed description that follows.

DESCRIPTION OF THE PREFERRED EMBODIMENT

Figure 1:
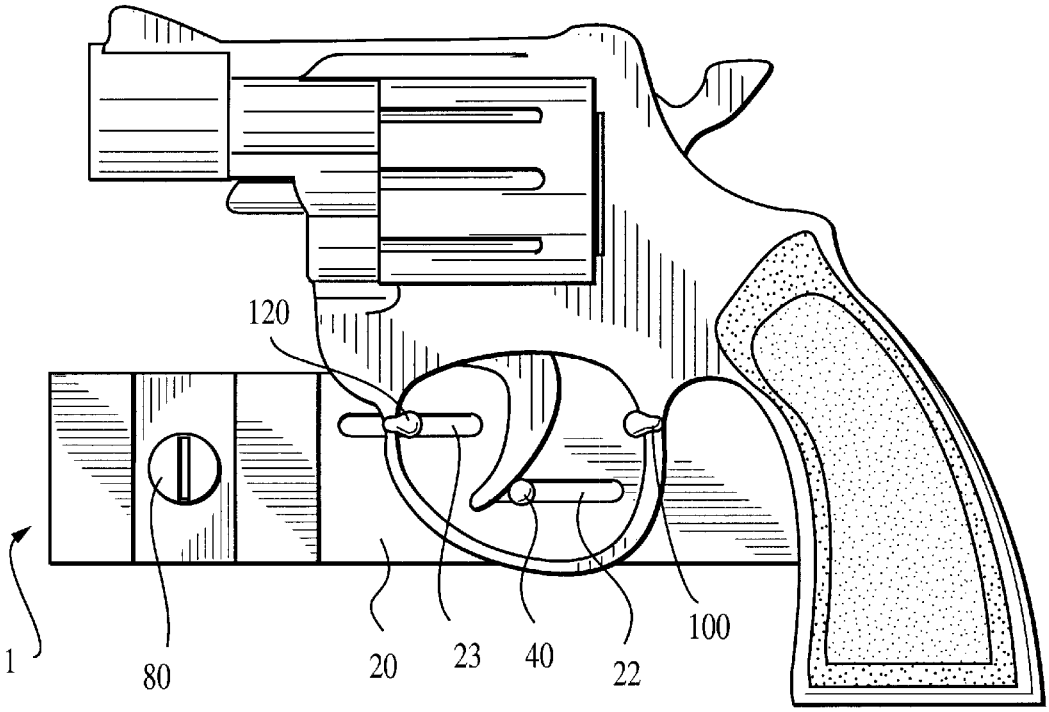
FIG. 1 is a side view of a preferred embodiment of the present invention which illustrates the placement of the invention on a firearm, having a trigger and a trigger guard, in such a manner as to prevent the firearn's operation.

Referring now to the drawings wherein are shown preferred embodiments and wherein like reference numerals designate like elements throughout, there is shown in FIG. 1 a side view of a preferred embodiment of the present invention which illustrates the placement of the invention on a firearm, having a trigger and a trigger guard, in such a manner as to prevent its operation.

Figure 2:
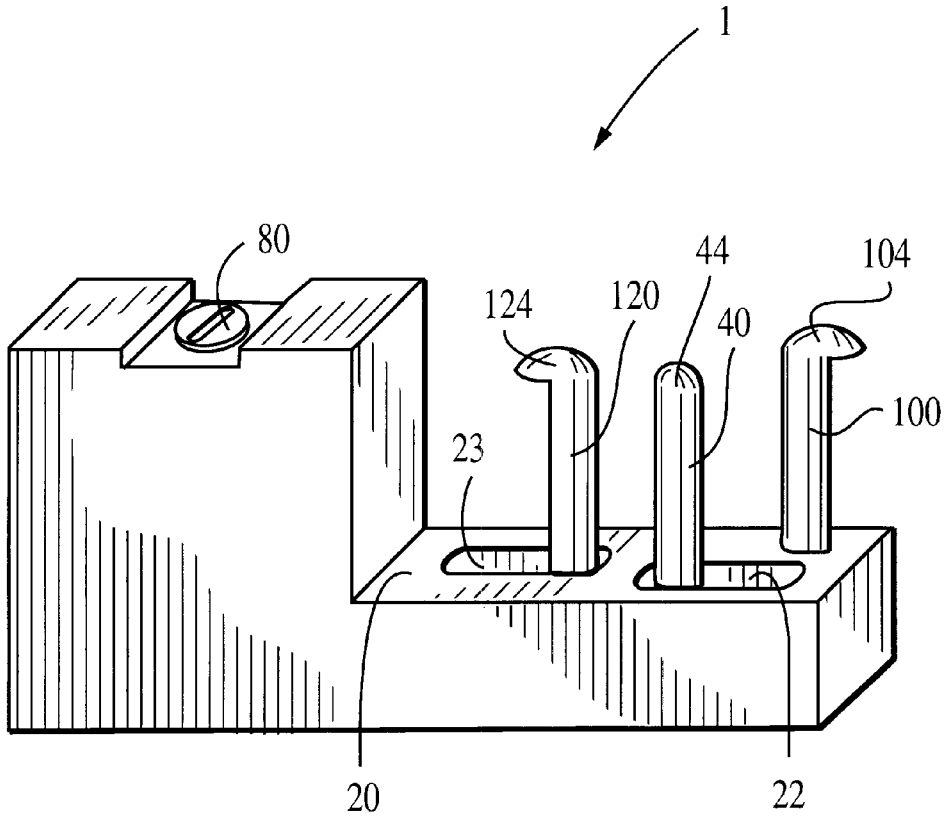
FIG. 2 is a perspective view of a preferred embodiment of the present invention.

FIG. 2 is a perspective view of a preferred embodiment of the present invention. It is seen to comprise three spaced apart pins (40, 100, 120) that cooperate to prevent trigger movement by having one (40) of the pins placed behind the trigger, another (120) of the pins placed inside the front portion of the trigger guard, while the final pin (100) is fixed against the inside of the trigger guard at a position behind the trigger, and means for holding and locking these pins in this spaced apart relationship.

Figure 3:
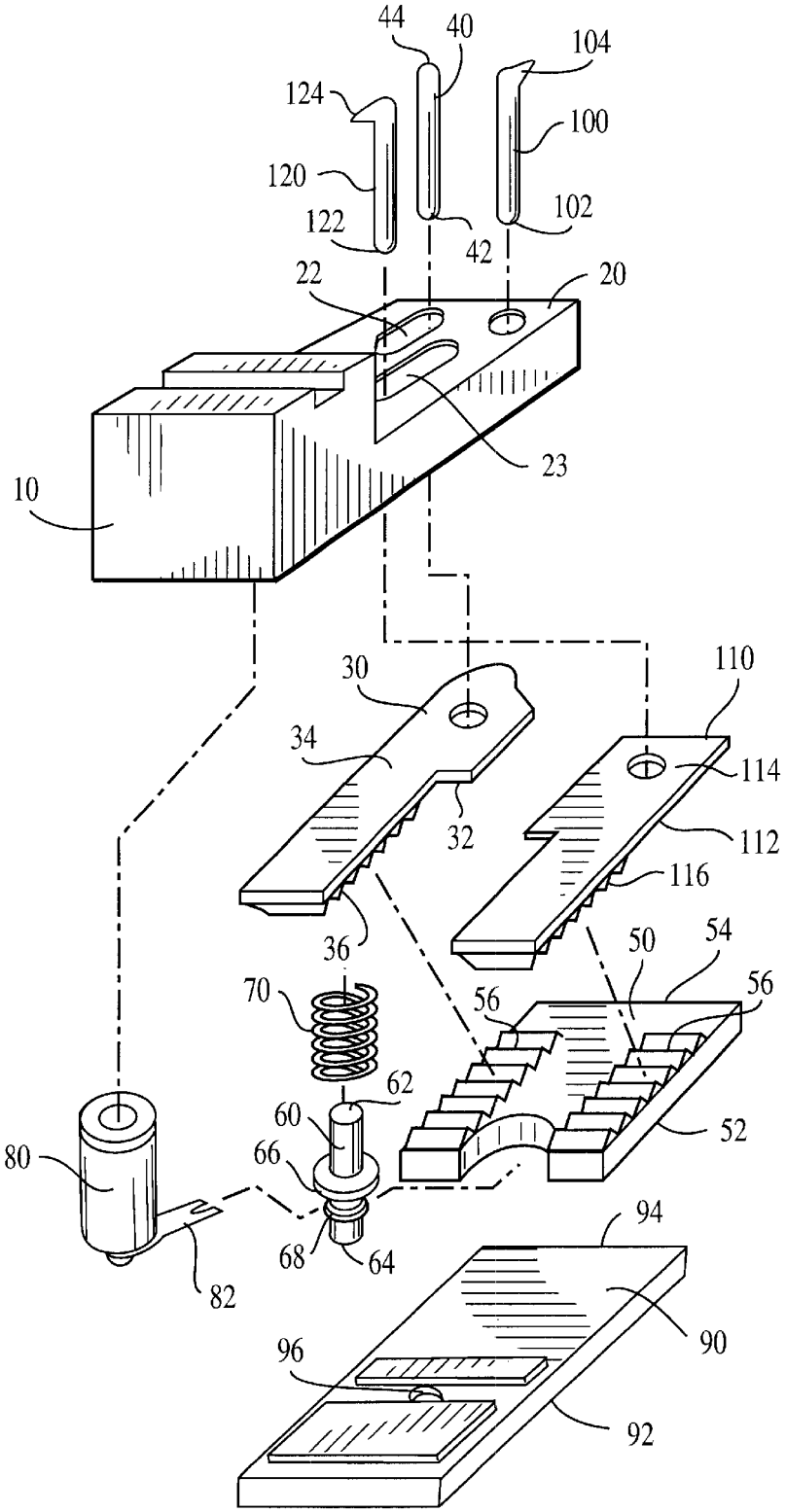
FIG. 3 is an exploded, perspective view of the elements that comprise the preferred embodiment shown in FIG. 2.
Figure 4:
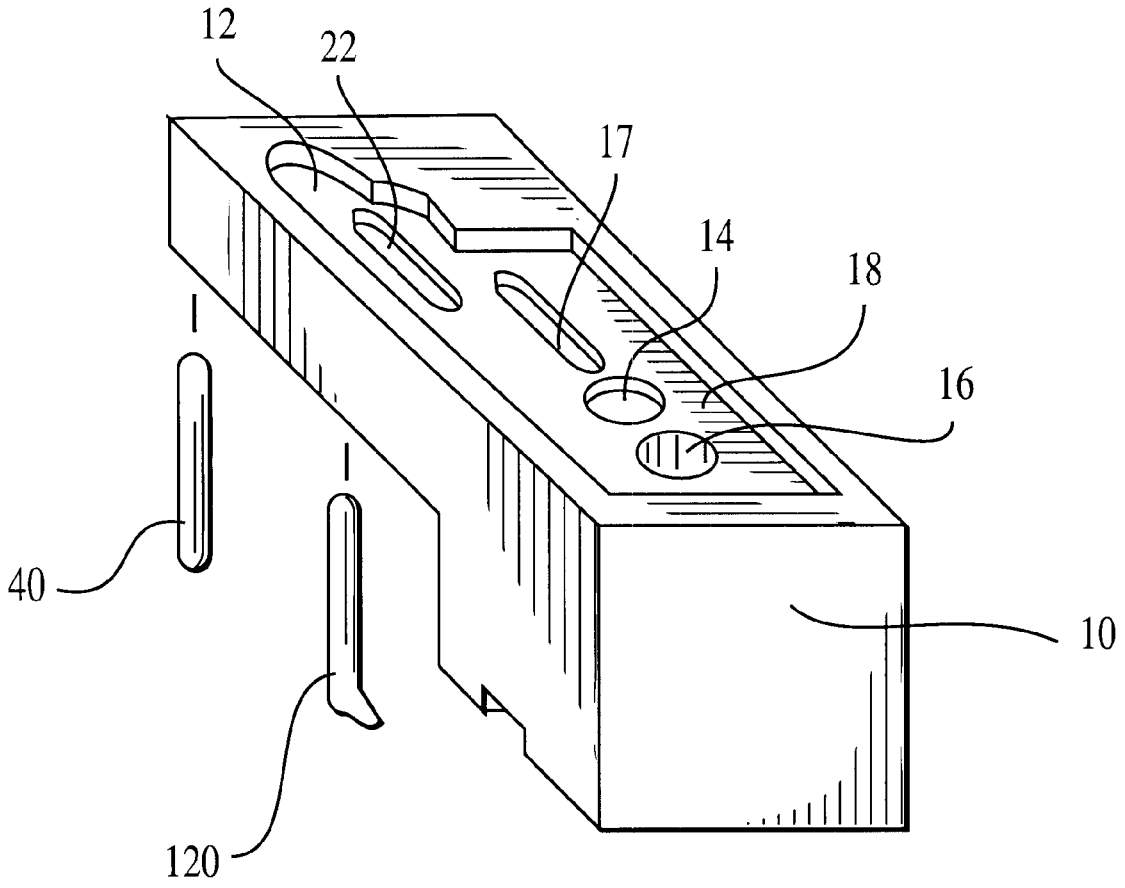
FIG. 4 is a perspective view of the interior portion of a base element as shown in the preferred embodiment of FIG. 3.

To better understand the internal elements of this preferred embodiment, FIG. 3 is provided and illustrates an exploded, perspective view of the elements that comprise the embodiment shown in FIG. 2.

The means for holding the pins (40, 100, 120) in a spaced apart relationship is seen to comprise: (a) a base (10) configured to have first (12), second (14), and third (16) hollow interior portions, an open top surface (18), a bottom, exterior surface (20), a first (22) and a second (23) elongated slot (22) in the bottom exterior surface (20), (b) a first latch plate (30) having a top (32) and a bottom (34) side, (c) a second latch plate (10) having a top (112) and a bottom (114) side, wherein these plates (30, 110) are slidably mounted in the base interior portion and have a portion of their top sides having toothed sections (36, 116), (d) a keeper plate (50) having a top (52) and a bottom (54) side, with a portion of this bottom side having a toothed section (56) that is meshable with the plate toothed sections (36, 116), wherein this keeper plate (50) is movable between a first position in which the toothed sections (36, 56, 116) mesh so as to lock and restrict the latch plates (30, 110) from sliding, and a second position in which the toothed sections (36, 56, 116) are not meshed so that the latch plates (30, 110) may slide within the base, (e) a set cylinder (60) having an axis and a bottom (62) and a top (64) end, a bottom (66) and a top (68) sleeve, each of which extends perpendicular to the cylinder axis, with the cylinder being slidably mounted for axial motion in the base's second interior portion (14), and a portion of the bottom sleeve (66) engaging a portion of the keeper plate bottom side (54), (f) a means for biasing the cylinder (60) for motion along its axis from a first position in which the keeper toothed section (56) meshes with the latch plate toothed sections (36, 116) so as to lock and restrict the latch plates (30, 110) from sliding, and to a second position in which the toothed sections (36, 56, 116) are not meshed so that the latch plate (30, 110) may slide within the base's interior portion, and (g) a cover plate (90) having a top (92) and a bottom (94) surface, the plate (90) covering the base open top surface (18) and cooperating to hold and regulate the motion of the plates, cylinder and biasing means, with the plate (90) having an aperture (96) through which the top end (64) of the cylinder protrudes, and the top cylinder sleeve (68) engaging with the plate bottom surface (94) so as to control the height above the plate top surface (92) to which the cylinder top end (64) protrudes.

This top cylinder end (64) is seen to function as a button for manually moving the top cylinder end (64) toward the cover plate top surface (92) so as to move the cylinder (60) to its first position and thereby locking said toothed sections (36, 56, 116) together until the locking means (4) is employed for this task.

Meanwhile, the pins themselves consist of a first movable pin (40), one end of which is affixed to the first latch plate (30) such that its other free end (44) extends normal to the plate and passes through the base's first slot (22) where it is free to be placed against and behind the trigger. Similarly, a second movable pin (120), one end of which is affixed to the second latch plate (110) such that its other free end (124) extends normal to the plate and passes through the base's second slot (23) where it is free to be placed against a front, inside position of the trigger guard. A third pin (100) has its base end (102) affixed to the base exterior surface (20) such that its other free end (104) extends from the base so that it may be placed against a position on the inside of the trigger guard, behind the trigger, and in a spaced apart and operative relation to the movable pins (40, 120).

The means for locking the pins in this spaced apart relationship can be accomplished by employing any one of a variety of locking mechanisms. The locking mechanism shown in FIG. 3 is of the key operated variety. It is seen to consist of a standard lock mechanism (80) that is configured to fit within the base's third interior portion (16). A rotatable lever (82) extends from one end of the mechanism such that the lever's distal end can be rotated so as to contact the cylinder's top sleeve (68) and hold the cylinder (60) in its first position and thereby lock the toothed sections (36, 56, 116) together.

Materials suitable for construction of the various elements of the present invention include aluminum and steel in order to maximize the lock's durability.

Although the foregoing disclosure relates to preferred embodiments of the invention, it is understood that these details have been given for the purposes of clarification only. Various changes and modifications of the invention will be apparent, to one having ordinary skill in the art, without departing from the spirit and scope of the invention as hereinafter set forth in the claims.

I claim:

1. A trigger lock (1) for use on a firearm having a trigger and a trigger guard, with the firing of said firearm being initiated by the rearward movement of said trigger, said lock comprising:

a plurality of pins cooperating to prevent initiation of movement of said trigger, with one or more of said pins being movable between a first and a second spaced apart position, wherein in said second position said trigger movement is restricted by having one of said pins placed against a position on the rear portion of said trigger and another of said pins placed in a spaced apart relationship and against a position on the inside of said trigger guard and behind said trigger, a means for moving and holding one or more of said pins in said spaced apart relationship so as to resist the rearward movement of said trigger, a means for locking said pins in said spaced apart relationship.

2. A trigger lock (1) as recited in claim 1, wherein said means for moving and holding one or more said pins in said spaced apart relationship comprising:

a base (10) configured to have first (12), second (14) and third (16) hollow interior portions, an open top surface (18), a bottom, exterior surface (20), an elongated slot (22) in said bottom exterior surface (20) that provides access through said surface (20) from said first interior portion (12), a latch plate (30) having a top (32) and a bottom (34) side, said plate (30) being slidably mounted in said first interior portion (12), a portion of said top side having a toothed section (36), a keeper plate (50) having a top (52) and a bottom (54) side, a portion of said bottom side having a toothed section (56), said plate (50) being movable between a first position in which said toothed section (56) meshes with said latch plate toothed section (36) so as to lock and restrict said latch plate (30) from sliding, and a second position in which the toothed sections (36, 56) are not meshed so that said latch plate (30) may slide within said first interior portion (12), a set cylinder (60) having an axis and a bottom (62) and a top (64) end, a bottom (66) and a top (68) sleeve, each of which extends perpendicular to said cylinder axis, said cylinder being slidably mounted for axial motion in said second interior portion (14), a portion of said bottom sleeve (66) engaging a portion of said keeper plate bottom side (54), a means for biasing said cylinder (60) for motion along its axis from a first position in which said keeper toothed section (56) meshes with said latch plate toothed section (36) so as to lock and restrict said latch plate (30) from sliding, and to a second position in which the toothed sections (36, 56) are not meshed so that said latch plate (30) may slide within said first interior portion (12), and a cover plate (90) having a top (92) and a bottom (94) surface, said plate (90) covering said base open top surface (18), said plate (90) having an aperture (96) through which the top end (64) of said cylinder protrudes, said top cylinder sleeve (68) engaging with said plate bottom surface (94) so as to control the height above said plate top surface (92) to which said cylinder top end (64) protrudes, wherein at least one of said plurality of pins (2) comprising a movable pin (40), said pin being movable to said second position that is against a position on the rear portion of said trigger, said pin (40) having a plate (42) end and a free (44) end, said plate end (42) being affixed to the bottom surface (34) of said latch plate such that said free end extends normal to said surface (34) and passes through said slot (22).

3. A trigger lock (1) as recited in claim 2, wherein:

at least one of said plurality of pins comprising a fixed pin (100), which is placed against a position on the inside of said trigger guard and behind said trigger, said pin (100) having a base end (102) and a free end (104), said base end (102) being affixed to the base, bottom exterior surface (20) such that said free end (104) extends normal to said surface (20) and in a spaced apart and operative relation to said movable pin free end (44).

4. A trigger lock (1) as recited in claim 2, wherein:

wherein moving said protruding top cylinder end (64), to a position such that said end (64) is closer to said cover plate top surface (92), has the effect of manually moving said cylinder (60) to its first position and thereby locking said toothed sections (36, 56) together until said locking means is employed for this task.

5. A trigger lock (1) for use on a firearm having a trigger and a trigger guard, said lock comprising:

a base (10) configured to have first (12), second (14) and third (16) hollow interior portions, an open top surface (18), a bottom, exterior surface (20), an elongated slot (22) in said bottom exterior surface (20) that provides access through said surface (20) from said first interior portion (12), a latch plate (30) having a top (32) and a bottom (34) side, said plate (30) being slidably mounted in said first interior portion (12), a portion of said top side having a toothed section (36), a movable pin (40) having a plate (42) end and a free (44) end, said plate end (42) being affixed to the bottom surface (34) of said latch plate such that said free end extends normal to said surface (34) and passes through said slot (22), a keeper plate (50) having a top (52) and a bottom (54) side, a portion of said bottom side having a toothed section (56), said plate (50) being movable between a first position in which said toothed section (56) meshes with said latch plate toothed section (36) so as to lock and restrict said latch plate (30) from sliding, and a second position in which the toothed sections (36, 56) are not meshed so that said latch plate (30) may slide within said first interior portion (12), a set cylinder (60) having an axis and a bottom (62) and a top (64) end, a bottom (66) and a top (68) sleeve, each of which extends perpendicular to said cylinder axis, said cylinder being slidably mounted for axial motion in said second interior portion (14), a portion of said bottom sleeve (66) engaging a portion of said keeper plate bottom side (54), a means for biasing said cylinder (60) for motion along its axis from a first position in which said keeper toothed section (56) meshes with said latch plate toothed section (36) so as to lock and restrict said latch plate (30) from sliding, and to a second position in which the toothed sections (36, 56) are not meshed so that said latch plate (30) may slide within said first interior portion (12), a means for locking said set cylinder (60) in its first position so that said toothed sections (36, 56) are meshed together so as to lock and restrict said latch plate (30) from sliding, said means mounted in said third interior portion (16), a cover plate (90) having a top (92) and a bottom (94) surface, said plate (90) covering said base open top surface (18), said plate (90) having an aperture (96) through which the top end (64) of said cylinder protrudes, said top cylinder sleeve (68) engaging with said plate bottom surface (94) so as to control the height above said plate top surface (92) to which said cylinder top end (64) protrudes, and a fixed pin (100) having a base end (102) and a free end (104), said base end (102) being affixed to the base, bottom exterior surface (20) such that said free end (104) extends normal to said surface (20) and in a spaced apart and operative relation to said movable pin free end (44), wherein moving said protruding top cylinder end (64), to a position such that said end (64) is closer to said cover plate top surface (92), has the effect of manually moving said cylinder (60) to its first position and thereby locking said toothed sections (36, 56) together until said locking means is employed for this task, and wherein said lock (1) restricts movement of said trigger by placing the fixed pin free end (104) against a portion of the firearm trigger guard that extends behind said trigger while said movable pin free end (44) is placed behind and in contact with said trigger, and said pin free ends (44, 104) are held in a fixed, spaced apart relation by employing said locking means.

6. A trigger lock (1) as recited in claim 5 for use on a firearm having a trigger and a trigger guard, said lock further comprising:

said base (10) further having a fourth (17) hollow interior portions, a second elongated slot (23) in said bottom exterior surface (20) that provides access through said surface (20) from said fourth interior portion (17), a second latch plate (110) having a top (112) and a bottom (114) side, said plate (110) being slidably mounted in said fourth interior portion (17), a portion of said top side having a toothed section (116), a second movable pin (120) having a plate (122) end and a free (124) end, said plate end (122) being affixed to the bottom surface (114) of said second latch plate (110) such that said free end extends normal to said surface (14) and passes through said second slot (23), wherein said keeper plate (50) is further configured such that in its first position said toothed section (56) meshes with said second latch plate toothed section (116) so as to lock and restrict said latch plate (110) from sliding, while in its second position the toothed sections (116, 56) are not meshed so that said second latch plate (110) may slide within said fourth interior portion (17), and wherein said lock (1) further restricts movement of said trigger by placing the second, movable pin free end (124) behind and in contact with a portion of said trigger guard that extends in front of said trigger.

* * * * *